US009922601B2

(12) United States Patent
Lin et al.

(10) Patent No.: US 9,922,601 B2
(45) Date of Patent: Mar. 20, 2018

(54) BACKLIGHT UNIT AND DISPLAY DEVICE

(71) Applicant: InnoLux Corporation, Miao-Lu County (TW)

(72) Inventors: Chun-Hsu Lin, Miao-Li County (TW); Yi-Fen Chuang, Miao-Li County (TW); Tai-Chieh Huang, Miao-Li County (TW); Meng-Chang Tsai, Miao-Li County (TW); Ming-Feng Hsieh, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 260 days.

(21) Appl. No.: 14/816,219

(22) Filed: Aug. 3, 2015

(65) Prior Publication Data

US 2016/0037600 A1 Feb. 4, 2016

(30) Foreign Application Priority Data

Aug. 4, 2014 (TW) ..... 103126549 A

(51) Int. Cl.
*G09G 3/34* (2006.01)

(52) U.S. Cl.
CPC ... *G09G 3/3413* (2013.01); *G09G 2320/0242* (2013.01)

(58) Field of Classification Search
CPC ..... G09G 2320/0242; G09G 3/3413; G09G 3/3433; G09G 3/36; G09G 3/342
See application file for complete search history.

(56) References Cited

U.S. PATENT DOCUMENTS 8,810,611 B2 * 8/2014 Murai ..... G09G 3/3406 345/102

FOREIGN PATENT DOCUMENTS

CN 102472903 A 5/2012
TW 200719308 A 5/2007

OTHER PUBLICATIONS

Chinese language office action dated May 31, 2017, issued in application No. CN 201410379245.X.
TW Office Action dated Aug. 6, 2015 in corresponding Taiwan application (No. 103126549).

* cited by examiner

*Primary Examiner* — Ali Alavi
(74) *Attorney, Agent, or Firm* — McClure, Qualey & Rodack, LLP

(57) ABSTRACT

The invention provides a backlight unit used in a display device. The backlight unit includes a light source which is driven by a pulse wave having a predetermined duty cycle. The light source emits light including a first color light and a second color light. The frequency of the pulse wave is at least 360 Hz.

8 Claims, 7 Drawing Sheets

BACKLIGHT UNIT AND DISPLAY DEVICE

CROSS REFERENCE TO RELATED APPLICATIONS

This Application claims priority of Taiwan Patent Application No. 103126549, filed on Aug. 4, 2014, the entirety of which is incorporated by reference herein.

BACKGROUND OF THE INVENTION

Field of the Invention

The present invention relates to a backlight unit and a display device, and in particular to a backlight unit and a display device for displaying dynamic images without color leakage or with reduced color leakage.

Description of the Related Art

Pulse waves with a low duty cycle are widely used to drive today's display devices. FIG. 1 is a diagram illustrating the duty cycle of a pulse wave. The duty cycle of a pulse wave means a ratio ($\tau/T$) of the duration of one pulse ($\tau$) to the period of the pulse wave (T).

By controlling the duty cycle of the pulse wave to drive the backlight, techniques such as dynamic brightness adjustment, local dimming, power saving, backlight scanning, etc. can be implemented. The purposes of those techniques are to improve the contrast ratio of dynamic images, to save power, to reduce afterimages, etc.

However, the response characteristics of each material used by some light sources are different, causing light of different colors having different response times. When a pulse wave having a low duty cycle is used to drive the backlight, color leakage will be observed from the edge of a moving object in a dynamic image.

BRIEF SUMMARY OF THE INVENTION

A detailed description is given in the following embodiments with reference to the accompanying drawings.

To solve the problem listed above, some embodiments of the invention provide a backlight unit used in a display device. The backlight unit includes a light source which is driven by a pulse wave having a predetermined duty cycle. The light source emits light including a first color light and a second color light. The frequency of the pulse wave is at least 360 Hz.

According to some embodiments of the invention, the duty cycle of the pulse wave for driving the backlight may be constant. The light source of the backlight unit can still be driven with a pulse wave having a low duty cycle. Furthermore, because the frequency of the pulse wave in some embodiments is higher than that of the pulse wave in the prior art, the color leakages in the dynamic image displayed by the display device can be reduced.

In the backlight unit described above, the frequency of the pulse wave is an integer multiple of the frame rate of the display device.

In the backlight unit described above, the first color light and the second color light have different response characteristics when the light source is driven by a pulse.

In the backlight unit described above, the different response characteristics can be defined that the rising time difference between the first and second color lights is greater than 1 millisecond, or the falling time difference between the first and second color lights is greater than 1 millisecond.

According to some embodiments, based on the fact that lights of different colors have different response characteristics, a high-frequency driving pulse wave is used to drive the light source of the backlight unit. Whether the response characteristics are different can depend on whether the rising time difference between the first and second color lights or the falling time difference between the first and second color lights is greater than 1 millisecond.

In the backlight unit described above, the predetermined duty cycle can be within 1%~90%.

According to some embodiments, the backlight unit is operated under a low duty cycle for saving power, and the low duty cycle is within 1%~90%.

Some embodiments of the invention also provide a display device including: a display panel, a backlight unit, and a backlight driving circuit. The backlight unit comprises a light source emitting light including a first color light and a second color light. The backlight driving circuit drives the light source with a pulse wave having a predetermined duty cycle, wherein the frequency of the pulse wave is at least 360 Hz.

In the above display device, the frequency of the pulse wave can be an integer multiple of the frame rate of the display panel.

In the above display device, the first color light and the second color light have different response characteristics when the light source is driven by a pulse.

In the above display device, the different response characteristics can be defined that the rising time difference between the first and second color lights or the falling time difference between the first and second color lights is greater than 1 millisecond.

In the above display device, the predetermined duty cycle is within 1%~90%.

According to the backlight unit and display device described above, even though a driving pulse wave having a low duty cycle is used to drive the light source including lights of different colors with different response characteristics, the color leakages in the dynamic image displayed by the display device can be reduced.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

This description is made for the purpose of illustrating the general principles of the invention and should not be taken in a limiting sense. The scope of the invention is determined by reference to the appended claims.

Figure 1:
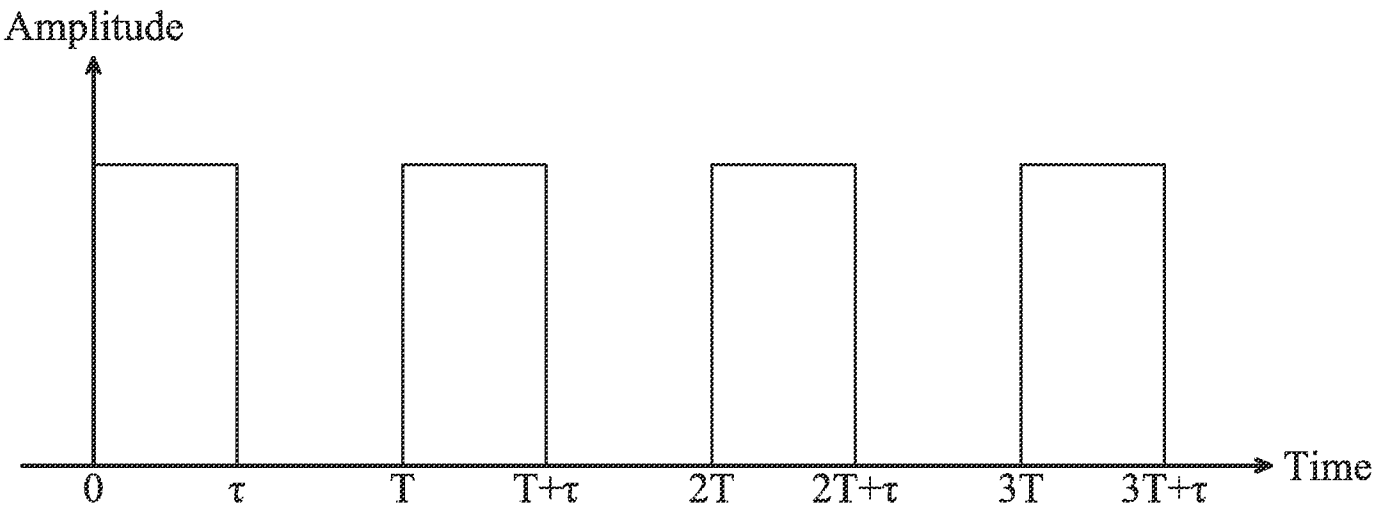
FIG. 1 is a diagram illustrating a duty cycle of a pulse wave.
Figure 2:
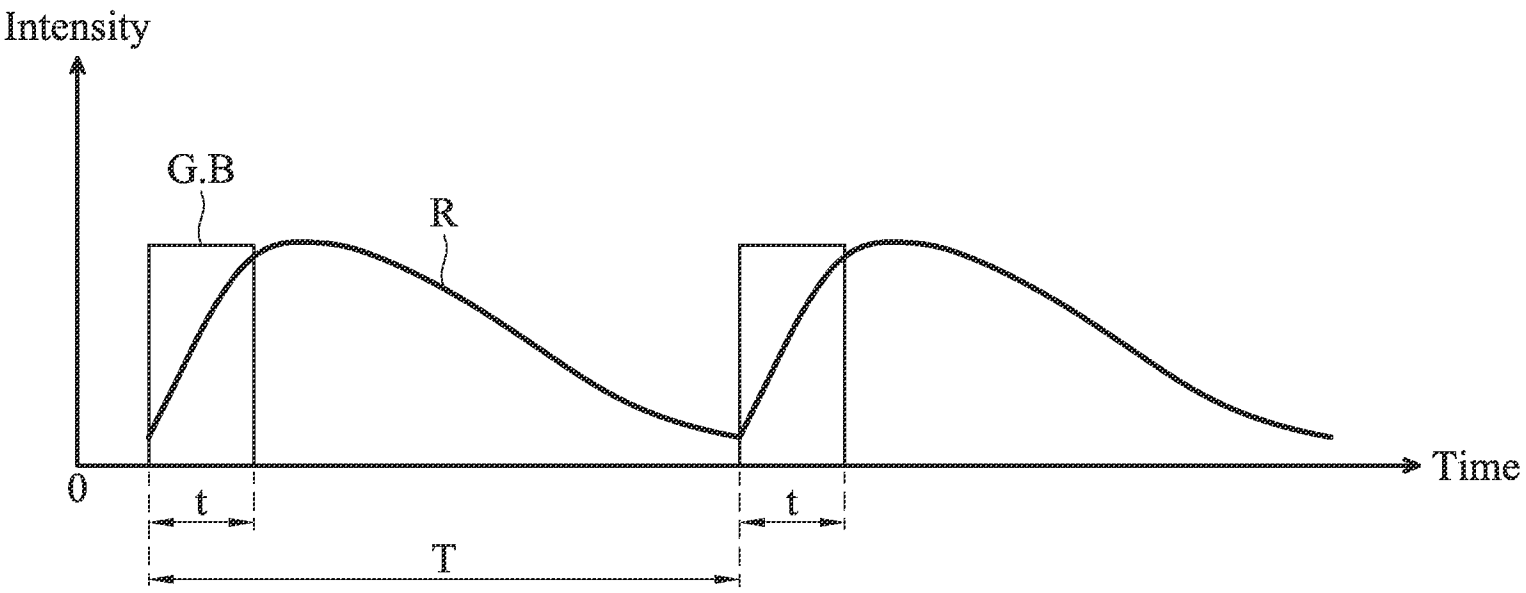
FIG. 2 is a diagram illustrating the difference in response characteristics of lights of different colors when a pulse wave having a low duty cycle drives the light source of the display according to conventional technology.

FIG. 2 is a diagram illustrating the difference in response characteristics of lights of different colors when a pulse wave having a low duty cycle drives the light source of the display according to conventional technology. In FIG. 2, the horizontal axis represents time and the vertical axis represents light intensity of different colors. Assuming that the period of a driving pulse wave for the light source is T and the duration of a pulse is t (or called a driving period), the duty cycle of this driving pulse wave is t/T. When the driving pulse wave is used to drive a light source including a blue LED, a green phosphor, and a red phosphor, the response characteristic curves of the green light G and blue light B are almost the same as the waveform of the driving pulse wave as shown in FIG. 2. Namely, the green light G and the blue light B maintain at the maximum intensity during the driving period t and they are almost not emitted (completely dark) during the remaining period (or called a non-driving period). On the other hand, the response characteristic curve of the red light R is not close to the waveform of the driving pulse wave. When a pulse is input, the red light R rises slowly to the maximum and then falls slowly. The red light R falls continuously until the next driving pulse is input. Therefore, during the driving period t, the mixed color of the light emitted by the backlight tends to aqua blue, and during the non-driving period, the mixed color of the light emitted by the backlight tends to red.

In cases where lights of different colors (for example, green light, blue light, and red light) emitted by the light source exhibit obvious differences in the response characteristics, when the display device displays a static image, the colors of the green light G, the blue light B, and the red light R are mixed automatically in the human eye as time goes by, so a correct image can be seen by the user. However, when the display device displays a dynamic image, the human eye will trace the object moving on the screen, so color leakages are observed from the front edge and the back edge of the object ("front" and "back" are defined according to the object's direction of motion).

Figure 3A:
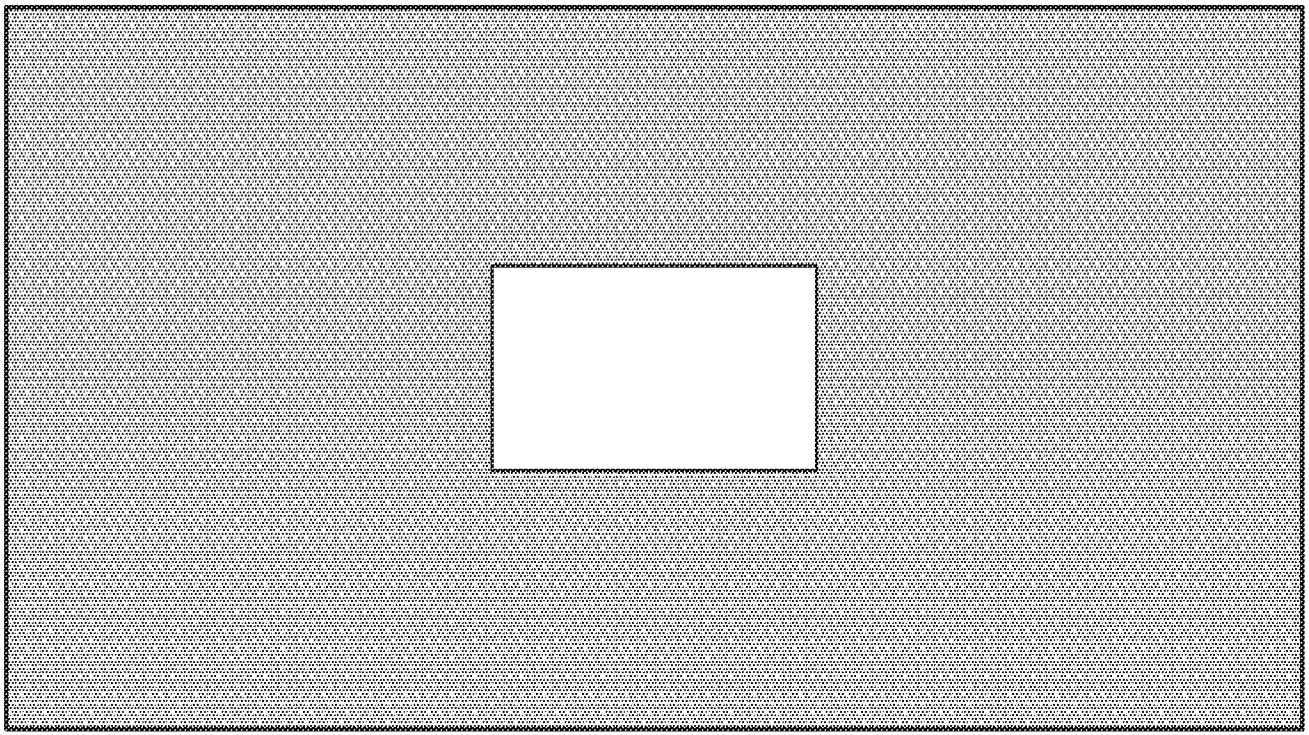
FIG. 3A is a diagram illustrating a static image.
Figure 3B:
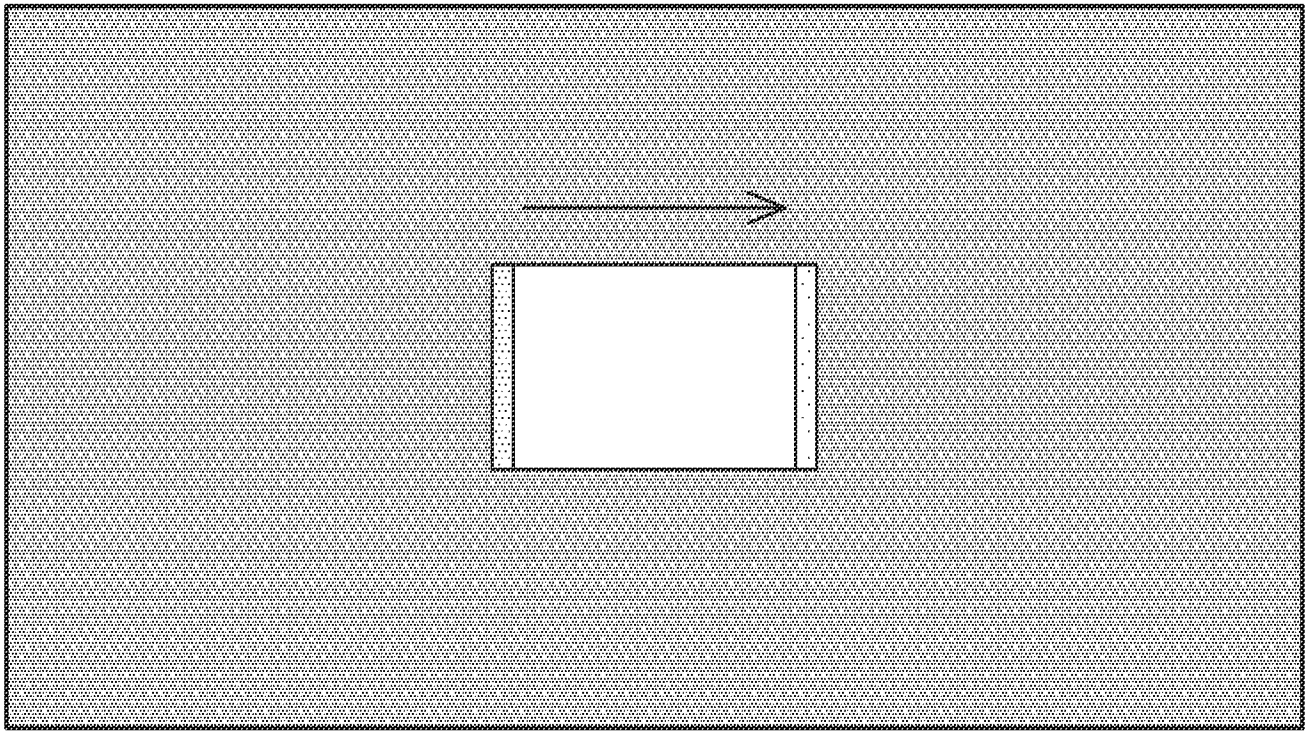
FIG. 3B is a diagram illustrating color leakages in a dynamic image.

An example to illustrate color leakage is shown in FIGS. 3A and 3B. FIG. 3A shows a static image. In the static image, a totally white and still rectangle is seen in the black background. FIG. 3B shows a dynamic image. In the dynamic image, when the rectangle moves from left to right in the direction the arrow is pointing, the human eye will trace the moving rectangle. According to the matching between the waveform of the response characteristics of the light source (time to the intensity of the light source curve as shown in FIG. 2) and the waveform of the response characteristics of liquid crystals (time to transmittance curve), different color leakage results are generated. For example, in FIG. 3B, the pulse wave with a low duty cycle is synchronized with the driving of the liquid crystal molecules. Blue color leak can be seen at the front edge (right edge) of the rectangle because of the matching between the waveform of the response characteristics of the light source and the waveform of the transmittance of liquid crystal molecules which are switched from the dark state to the bright state. At the back edge (left edge) of the rectangle; red color leakage can be seen because of the matching between the waveform of the response characteristics of the light source and the waveform of the transmittance of liquid crystal molecules which are switched from the bright state to the dark state.

In the prior art, the period of the driving pulse wave for the backlight is the same as the refresh period of the displayed image. Namely, when the frame rate is 60 Hz, the frequency of the driving pulse wave for the backlight is also 60 Hz. This kind of driving pulse wave for the backlight results in the aforementioned problem where color leaks at the edges of the moving object in the dynamic image.

Figure 6:
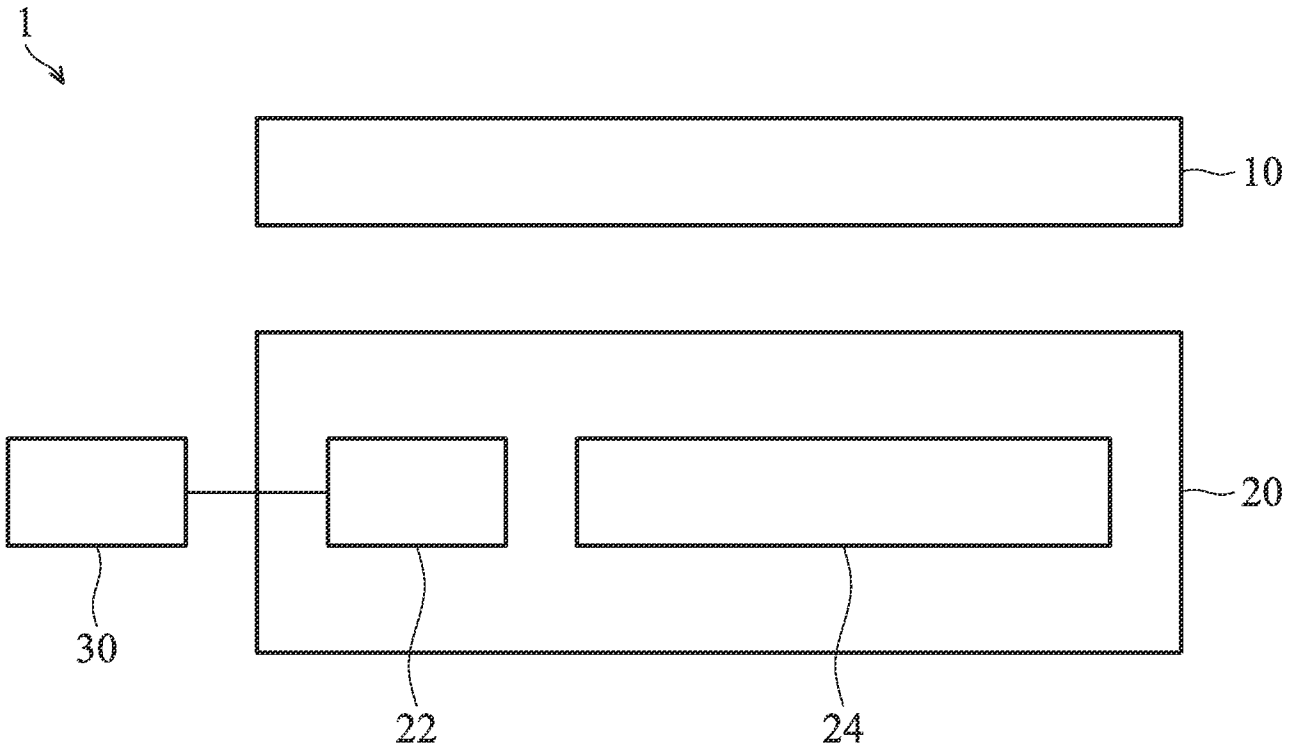
FIG. 6 is a block diagram illustrating a display device according to an embodiment of the present invention.

Therefore, when a light source emitting lights of different colors with different response characteristics is driven by a driving pulse wave with a low duty cycle, there is a need to improve the color leakages in the dynamic image. FIG. 6 is a block diagram illustrating a display device according to an embodiment of the present invention. The display device 1 includes a display panel 10, a backlight unit 20, and a backlight driving circuit 30. The backlight unit 20 includes a light source 22 and an optical plate or optical film 24. The optical plate or optical film 24 can include a light guide plate, diffusion plate or film, reflective plate or film, and prism. The backlight driving circuit 30 drives the light source 22 of the backlight unit 20 with a pulse wave having a predetermined duty cycle. The light source 22 emits light including a first color light and a second color light. For example, the light source 22 can include two colors of light or three colors of light. For example, the light source 22 can include a blue LED, a green phosphor, and a red phosphor. The blue light, green light, and red light emitted can have different response characteristics.

Figure 4:
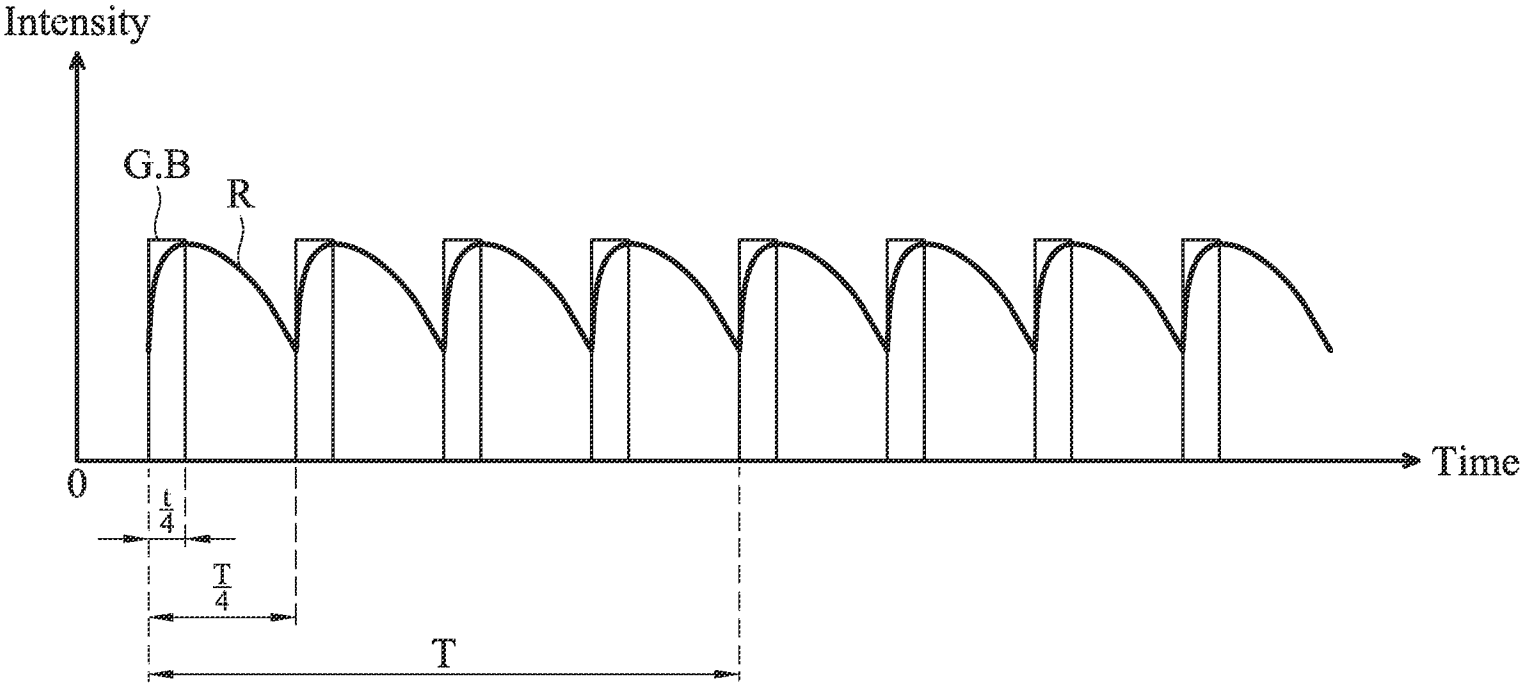
FIG. 4 is a diagram illustrating the difference in response characteristics of lights of different colors when a pulse wave having a low duty cycle drives the light source of the display in accordance with an embodiment of the invention.

FIG. 4 is a diagram illustrating the difference in response characteristics of lights of different colors when a pulse wave having a low duty cycle drives the light source of the display in accordance with an embodiment of the invention. Since the human eye is insensitive to the brightness variation of the high-frequency light source, the frequency (the number of pulses per second) of the driving pulse wave shown in FIG. 4 is increased to 4 times higher than that shown in FIG. 2. According to this embodiment, the duty cycle of the driving pulse wave is kept unchanged. Thus, the duration of each pulse (driving period) and the period of the pulse wave are decreased to ¼ the length of that shown in FIG. 2. Namely, the duration of each pulse becomes (¼)×t, and the period of the pulse wave becomes (¼)×T. When the light source is driven by the pulse wave with this frequency, the curves of the response characteristics of the green light G and the blue light B are still the same as the waveform of the driving pulse wave. Namely, the period in which the green light G and the blue light B are switched on is shortened to ¼ the length of the original one. Regarding the red light R, because the interval between pulses is shortened, the period in which the intensity of red light can fall from the peak is also shortened. In comparison with FIG. 2, in this embodiment, during one pulse wave, the intensity of red light falls with an extent not as great as in FIG. 2, then the intensity rises since the next driving pulse is coming immediately. Therefore, it will be more difficult for the human eye to sense the brightness change or color change under the high-frequency driving. This helps reduce the color leakage in the dynamic image.

In the above embodiment, it is taken as an example that the frequency of the driving pulse wave is 4 times higher than that of the prior art. However, in practice, according to some embodiments of the present invention, the frequency of the driving pulse wave can be determined according to the response characteristics of the light source and the liquid crystal molecules. Generally speaking, it is realized from experiments that it is more difficult to see the color leakages with the human eye when the frequency of the driving pulse wave reaches at least 360 Hz. According to some embodiments, the frequency of the driving pulse wave can be at least 360 Hz.

According to some embodiments of the present invention, the frequency of the pulse wave of the light source can be greater than the frame rate of the display panel. According to some embodiments, the frequency of the pulse wave of the light source can be an integer multiple of the frame rate of the display panel. For example, the integer can be two, three, four, five, six, and even greater than six. Thus, for each frame of the display device, the starting time point of the frame is the same as the starting time point of at least one driving pulse wave. For example, for a display panel having a frame rate of 60 Hz, the frequency of the driving pulse wave of the light source can be six or greater than six multiple of the frame rate of the display panel. For example, for a display panel having a frame rate of 120 Hz, the frequency of the driving pulse wave of the light source can be three or greater than three multiple of the frame rate of the display panel.

Figure 5:
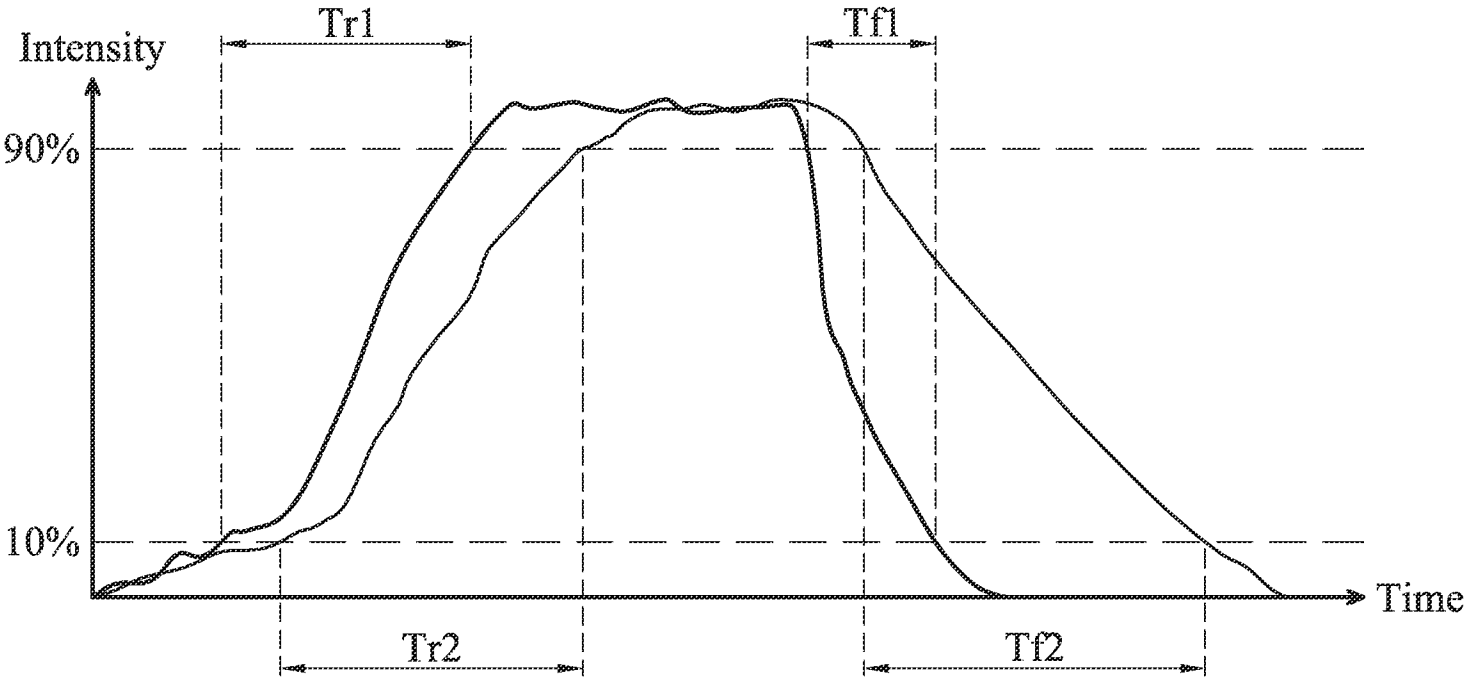
FIG. 5 is a diagram illustrating the rising time and the falling time of a signal.

Frequency multiplication for the driving pulse wave is utilized when there are obvious differences in the response characteristics of each color of light. When the response characteristics between lights of different colors included in the light source are close, the problem where color leaks in the dynamic image may not exist. In this case, it may not be necessary to perform frequency multiplication for the driving pulse wave of the light source. Specifically, according to some embodiments of the invention, if the rising time difference or the falling time difference between any two colors of light emitted by the light source is greater than 1 millisecond, the response characteristics of different colors of light are considered to have obvious differences. In this situation, the frequency multiplication can be performed for the driving pulse wave of the light source. On the other hand, if both the rising time difference and the falling time difference between any two colors of light emitted by the light source are less than 1 millisecond, the response characteristics of different colors of light are considered to be close to each other. In this situation, it may not be necessary to perform the frequency multiplication for the driving pulse wave of the light source. Here, the rising time is the time taken by a signal to change from 10% to 90% of the amplitude. The falling time is the time taken by a signal to change from 90% to 10% of the amplitude. Therefore, according to this definition, as shown in FIG. 5, it is assumed that the rising time and the falling time of light of one color is Tr1 and Tf1 respectively. The rising time and the falling time of light of another color is Tr2 and Tf2 respectively. According to some embodiments, when the rising time difference of the two colors of light $|Tr1-Tr2|$ or the falling time difference of the two colors of light $|Tf1-Tf2|$ is greater than 1 millisecond, the frequency multiplication for the driving pulse wave can be performed to drive the light source. Otherwise, the frequency multiplication for the driving pulse wave may not be necessary.

According to the embodiments described above, by utilizing the backlight unit and the display device including the backlight unit, even though there are obvious differences in the response characteristics between lights of different colors emitted from the light source, the color leakages in the dynamic image displayed by the display device can be reduced.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A backlight unit used in a display device, comprising
a light source which is driven by a pulse wave having a predetermined duty cycle,
wherein the light source emits light including a first color light and a second color light, and the first color light and the second light have different rising time, or the first color light and the second color light have different falling time when the light source is driven by a pulse,
wherein the frequency of the pulse wave is at least 360 Hz.

2. The backlight unit as claimed in claim 1, wherein the frequency of the pulse wave is an integer multiple of the frame rate of the display device.

3. The backlight unit as claimed in claim 1, wherein the predetermined duty cycle is within 1%~90%.

4. The backlight unit as claimed in claim 1, wherein the rising time difference between the first color light and second color light or the falling time difference between the first color light and second color light is greater than 1 millisecond.

5. A display device, comprising:
a display panel,
a backlight unit comprising a light source, wherein the light source emits light including a first color light and a second color light, and the first color light and the second light have different rising time, or the first color light and the second color light have different falling time when the light source is driven by a pulse, and
a backlight driving circuit driving the light source with a pulse wave having a predetermined duty cycle,
wherein the frequency of the pulse wave is at least 360 Hz.

6. The display device as claimed in claim 5, wherein the rising time difference between the first color light and second color light or the falling time difference between the first color light and second color light is greater than 1 millisecond.

7. The display device as claimed in claim 5, wherein the frequency of the pulse wave is an integer multiple of the frame rate of the display panel.

8. The display device as claimed in claim 5, wherein the predetermined duty cycle is within 1%~90%.

* * * * *